United States Patent [19]

Vecchieschi

[11] Patent Number: 4,970,818

[45] Date of Patent: Nov. 20, 1990

[54] MAGAZINE FOR FIRE-ARMS

[76] Inventor: Gastone Vecchieschi, Via Buozzi 78, Grosseto, Italy

[21] Appl. No.: 424,208

[22] PCT Filed: Apr. 6, 1988

[86] PCT No.: PCT/EP88/00289

§ 371 Date: Oct. 11, 1989

§ 102(e) Date: Oct. 11, 1989

[87] PCT Pub. No.: WO88/08113

PCT Pub. Date: Oct. 20, 1988

[30] Foreign Application Priority Data

Apr. 14, 1987 [IT] Italy ..... 16102 A/87

[51] Int. Cl.[5] ..... F41C 25/02

[52] U.S. Cl. ..... 42/50; 89/34

[58] Field of Search ..... 42/50, 49.01; 89/34

[56] References Cited

U.S. PATENT DOCUMENTS

| | | | |
|---|---|---|---|
| 2,366,689 | 1/1945 | Trotter | 89/34 |
| 2,557,144 | 6/1951 | Schaich | 42/50 |
| 3,732,643 | 5/1973 | Wells | 42/50 |
| 4,598,490 | 7/1986 | Savioli | 42/50 |

FOREIGN PATENT DOCUMENTS

| | | |
|---|---|---|
| 43431 | 5/1988 | Fed. Rep. of Germany . |
| 44923 | 10/1988 | Fed. Rep. of Germany . |
| 48108 | 8/1989 | Fed. Rep. of Germany . |
| 482212 | 4/1938 | United Kingdom . |

*Primary Examiner*—David H. Brown

*Attorney, Agent, or Firm*—Roylance, Abrams, Berdo & Goodman

[57] ABSTRACT

The magazine (1) has a mouth (3) for bullet entry in correspondence of an end thereof, and a thrust element (8) elastically urged towards the bullet entry mouth (3). In correspondence of the mouth (3) at least one pawl (10) is provided, which is pushed by a spring (11) to a lock postion, in which it retains the bullets (4) which are urged against it by the thrust element (8), the pawl (10) being movable, against the action of the spring (11), to reach a position of disengagement of the opening of the mouth (3), in which position it allows the bullets (4) to be entered perpendicularly to their axis, in the longitudinal direction of the magazine (1). The pawl (10) has a substantially 'V'-shaped configuration, hinged in correspondence of the vertex of the 'V'.

6 Claims, 2 Drawing Sheets

MAGAZINE FOR FIRE-ARMS

The present invention relates to a magazine for firearms, of the type comprising a substantially parallelepipedon housing, provided with a mouth for bullet entry at an end thereof, and a thrust element elastically urged inside the housing towards the bullet entry mouth, said mouth having a narrowing formed by two opposite magazine lips, and further comprising means for retaining the bullets inside the housing under the elastic thrust action applied by the thrust element, the bullets being positioned perpendicularly to the longitudinal direction of the housing.

Magazines of this type are generally known in the art, in U.S. Pat. No. 2,557,144, FIG. 10. In them the bullets, introduced through the mouth and positioned above each other inside the magazine, are then caused to leave the magazine after each other through a front opening provided in correspondence of the entry mouth, by sliding perpendicularly to the longitudinal direction of the magazine while guided by the Lip which define the two side walls of the entry mouth.

These magazines suffer from the main drawback that the loading of the bullets results quite difficult and requires a certain skill, in that the bullets cannot be directly introduced through the above-said two lips, which are too close to each other, in that they must retain the inserted bullets, but they have to be introduced through the front opening, and then orientated and pushed in the direction of their axis into the housing, the whole against the elastic action of the thrust element.

In order to obviate this drawback, devices have already been proposed, which are designed to make easier the introduction of the bullets into the magazine, at the same time securing that, once introduced inside the housing, they will be retained. One of such devices is known from GB No. 482,212.

These devices substantially comprise an elastically urged retainer element, which is arranged adjacent the magazine mouth and which enables the bullets to pass in one direction, and not pass in the reverse direction. However, installing this element requires that the magazine has a special structure, with said magazine having to be modified at its entry mouth, where it must receive the retainer element. As a consequence, not only the dimensions of said magazine have to be increased - with larger overall dimensions thereof - but, above all, the weapon can no longer house the magazine or has to be modified too. In other words, the magazines known from the prior art equipped with the retainer device are not any longer suitable for all weapon types, or, at least, for the main most widely diffused weapon types, but they are only suitable for weapons purposely adapted to them.

Some magazines of the prior art are then not even directly loadable, but they require the use of a purposely provided loading device, inside which a set of bullets is first loaded, the bullets are then introduced, together with said loading device, inside the magazine, and the device is finally extracted, without the bullets in, DE No. 48,108. One additional operation has therefore to be carried out, which renders rather impractical these magazines.

The purpose of the present invention is to provide a magazine of the initially indicated type, which makes it possible for the bullets to be easily introduced by means of one single movement in the longitudinal direction of the housing of the magazine, with the bullets being reliably retained, and which does not practically require any increases in the overall dimensions of the magazine, with no fitting of the weapon to the magazine being required.

A further purpose of the invention is to provide a magazine of the above mentioned type, which has such a structure, as to favour the bullets to be correctly expelled for shooting.

These and still further purposes, which will result more clearly from the following disclosure, are achieved by a magazine of the initially cited type, wherein said retaining means comprise at least one pawl hinged at said mouth on an axis substantially parallel to the longitudinal direction of the mouth and pushed by a spring to a lock position, in which a stop portion of the pawl rests on an external face of a wall of the housing and an engagement portion of the pawl protrudes into the opening of the bullet entry mouth and retains the bullets which are urged against it by the thrust element, the pawl being movable, against said spring, to a position of disengagement, in which it allows the bullets to be entered perpendicularly to their axis, in the longitudinal direction of said housing, characterized in that the pawl has a substantially reverse "V" -shaped configuration and is hinged at the vertex of the "V" astride one of the two lips of the entry mouth, and in that the spring is a blade spring entering, at one end, between the prongs of the "V", and fastened, at its other end, to the housing, the spring extending generally in the longitudinal direction of said wall of the housing.

In a magazine according to the invention, the arrangement of a "V"-shaped pawl generally astride the wall of the magazine housing and the arrangement of a blade spring pentrating between the prongs of the pawl does not practically involve any increase in the overall dimensions, and is limited to the only area which is immediately near the lip of the entry mouth. As a consequence, the magazine does not substantially require any modifications, nor any weapon fitting is necessary. The application of the pawl is particularly easy, and does not require complex operations, so that in the manufacturing of the magazine no considerable increases in costs have to be coped with. The insertion of the bullets does not require any use of auxiliary devices.

Further details and advantages of the invention will be more evident from the following disclosure of a preferred particular form of embodiment of the invention, depicted, for illustrative purposes, in the hereto attached drawing, wherein.

Figure 1:
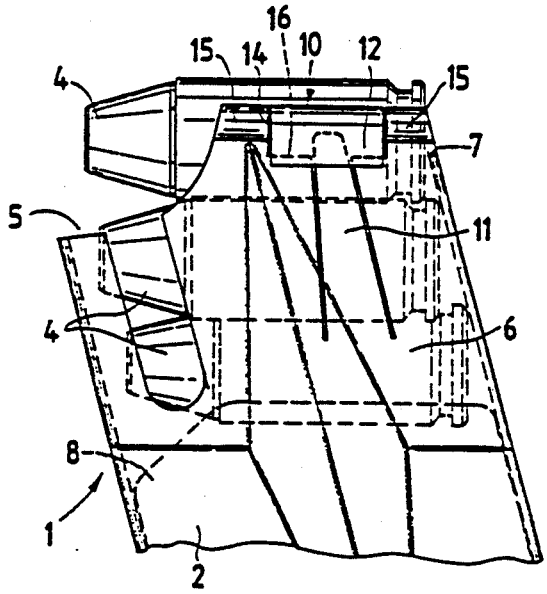
FIG. 1 shows a partial side elevation view of a magazine according to the invention.
Figure 2:
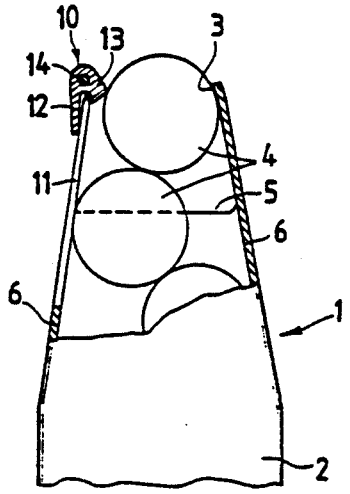
FIG. 2 shows a partially sectional rear view of the upper portion of the magazine of FIG. 1, in the bullet lock position.

Referring to these figures, a magazine 1 according to the invention comprises a substantially parallelepipedon housing 2, with an entry mouth 3 for the bullets 4 at its top end, with the mouth 3 being open upwards and on one side, wherein a front opening 5 is defined, through which the bullets 4 leave the magazine for shooting.

Advantageously, the mouth 3 has a narrowing formed by two opposite magazine lips of two mutually opposite side walls 6 of the housing 2; in the region opposite to the opening 5, a hollow 7 is provided, which makes it possible to push the bullets 4 into the firing chamber of the fire-arm.

Inside the housing 2 a thrust element 8 is positioned in a known way, with said thrust element 8 being elastically urged by a substantially spiral spring in the direction of the entry mouth 3, so as to urge the bullets 4 to an engagement position with the narrowed side walls 6 at the mouth 3.

In order to favour the entry of the bullets 4 in the longitudinal direction of the housing 2, but with the axis of the bullets 4 being perpendicular to this direction, and, in order to reliably retain the bullets 4 under the action applied by the thrust element 8, at at least one side of the mouth 3, at least one pawl 10 is provided, which is elastically urged by a spring 11 to a lock position, in which is locks the bullets 4 urged against it by the thrust element 8. The pawl 10 is movable, against the spring 11, to a position of disengagement of the opening of the mouth 3, in which it makes it possible the bullets 4 to be introduced perpendicularly to the longitudinal direction of the magazine 1.

The pawl 10 is hinged on an axis parallel to the longitudinal direction of the mouth 3 and has a substantially angled, "V"-shaped configuration. One of the prongs (12) of the "V" defines a stop portion, which is suitable for coming to rest, with its external side, towards the narrowed wall 6 of the housing when the pawl 10 is in its lock position, and the other prong (13) defines a bullet engagement portion protruding into the opening of the mouth 3 when said pawl is in its aboveside lock position, in which it reduces the transversal opening of the mouth 3 to a size smaller than the diameter of the bullets 4.

The pawl 10 is hinged by means of a pivot 14, hold by bent portions 15 of the edge of the mouth 3. Such an arrangement makes it easier the pawl 10 to be both manufactured and assembled.

As shown in the drawings, the pawl 10 has a marked reverse "V"-shape, substantially hinged to the pivot 14 at the vertex of the "V", astride one of the two lips of the entry mouth 3. The spring 11 is constituted by a blade spring, entering, at one end, between the prongs of the "V", and fastened with its other end to the housing 2, the spring 11 extending generally in the longitudinal direction of the wall 6 of the housing 2. In particular case depicted, the blade spring 11 is formed by a tongue portion cut from the side wall 6 of the housing. Such an arrangement eliminates the need of using and assembling a distinct spring, and, furthermore, reduces the encumbrances.

Figure 3:
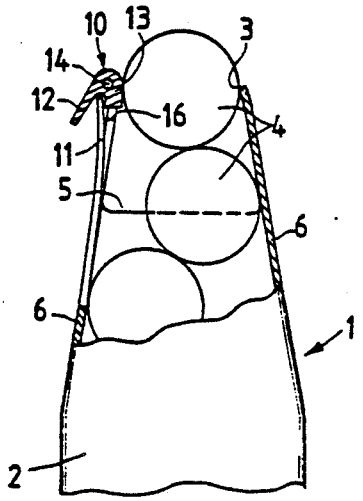
FIG. 3 shows a view similar to that of FIG. 2, in the bullet introduction position.
Figure 4:
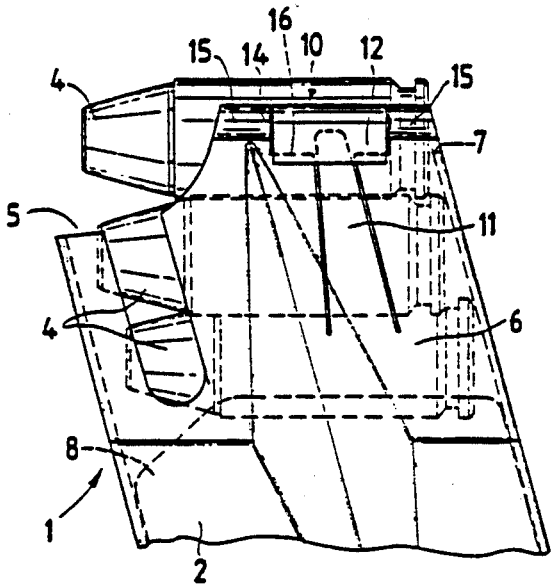
Figure 5:
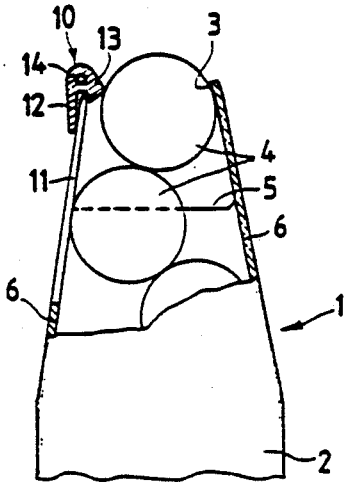
Figure 6:
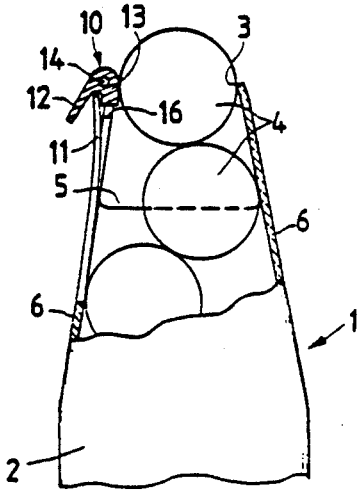

As visible in the drawings, the two prongs 12 and 13 of the "V"-shaped pawl are different in length, and more precisely, the external stop prong is longer than the internal engagement one. The wall of the housing 2 is provided with a seat 16 suitable for receiving the engagement portion 13 of the pawl 10 when the pawl moves to its position of disengagement of the opening of the mouth 3. The blade spring 11 protrudes with its face end into said seat 16, thus elastically acting on the portion 13 at the bullet introduction time (FIG. 3).

As it can be seen in FIG. 1, the stop portion 12 of the pawl 10 has a width larger than the width of the blade spring 11, so as to secure the pawl 10 to rest in its correct position.

From the above disclosure, one can understand that when the bullets 4 are introduced, the pawl 10 is pushed by the bullet 4, owing to the pressure applied by the user hand acting on the magazine 1, tilting due to the applied pressure, and consequently leaving free the passage for the bullet 4. As soon as the pressure is removed, because the passage has occurred of the bullet 4 into the magazine 1, the pawl 10 is returned by the spring 11, and automatically moves back to its closing position. The bullet 4 is thus imprisoned, because it is pushed upwards again by the element 8. In this position, the bullet 4 can only leave the magazine by moving forwards through the opening 5 by axial sliding, it being advantageously guided by the longitudinal edge of the portion 13 of the pawl 10, so as to secure the correct expulsion movement of the bullet 4.

The bullet introduction operation is repeated until the loading of the bullets 4 is complete.

Of course, two pawls 10 and respective springs 11 could be provided for, with one pawl on each one of the two mutually opposite side walls 6 of the entry mouth 3. In this case too, the configuration of the magazine would not be changed to any considerable extent, and the magazine would remain suitable for use in any weapon types.

Thanks to the tapered configuration of the mouth 3, one bullet 4 at a time can be introduced even in case the magazine is of the type suitable for receiving two rows of side-by-side bullets; thus, the introduction of the bullets 4 by the user is made easier. Furthermore, each bullet is individually guided, when leaving the magazine 1, by the longitudinal edge of the portion 13 of the pawl 10.

I claim:

1. Magazine for fire-arms, comprising a substantially parallelepipedon-shaped housing (2), provided with a mouth (3) for bullet entry at an end thereof, and a thrust element (8) elastically urged inside the housing (2) towards the bullet entry mouth (3), said mouth (3) having a narrowing formed by two opposite magazine and further comprising means for retaining the bullets (4) inside the housing under the elastic thrust action applied by the thrust element (8), the bullets (4) being positioned perpendicularly to the longitudinal direction of the housing (2), wherein said retaining means comprise at least one pawl (10) hinged at said mouth (3) on an axis substantially parallel to the longitudinal direction of the mouth (3) and pushed by a spring (11) to a lock position, in which a stop portion (12) of the pawl (10) rests on an external face of a wall (6) of the housing (2) and an engagement portion (13) of the pawl (10) protrudes into the opening of the bullet entry mouth (3) and retains the bullets (4) which are urged against it by the thrust element (8), the pawl (10) being moveable, against said spring (11), to a position of disengagement, in which it allows the bullets (4) to be entered perpendicularly to their axis, in the longitudinal direction of said housing (2), characterized in that the pawl (10) has a substantially reverse "V"-shaped configruation and is hinged at the vertex of the "V" astride one of the two lips of the entry mouth (3), and in that the spring (11) is a blade spring entering, at one end, between the prongs of the "V", and fastened, at its other end, to the housing (2), the spring (11) extending generally in the longitudinal direction of said wall (6) of the housing (2).

2. Magazine according to claim 1, characterized in that it is provided with a pawl (10) and spring (11) on each of two opposite walls (6) of the bullet entry mouth (3).

3. Magazine according to claim 1, characterized in that the blade spring (11) is formed by a tongue portion cut from the wall (6) of the housing (2).

4. Magazine according to claim 3, characterized in that the wall (6) of the housing (2) is provided with a seat (16) for receiving the engagement portion (13) of the pawl (10) when the pawl (10) moves to its position of disengagement of the opening of the bullet entry mouth (3), and that the blade spring (11) protrudes with said one end into said seat (16).

5. Magazine according to claim 4, characterized in that the stop portion (12) of the pawl (10) has a width larger than the width of the blade spring (11).

6. Magazine according to claim 5, characterized in that said stop portion (12) of the pawl (10) is longer than said engagement portion (13).

* * * * *